US011306559B2

(12) United States Patent
Zhang et al.

(10) Patent No.: US 11,306,559 B2
(45) Date of Patent: Apr. 19, 2022

(54) DEGRADABLE ANCHORING DEVICE WITH GAVANIC CORROSION RESISTANT COMPONENT INTERFACE

(71) Applicants: Zhihui Zhang, Katy, TX (US); YingQing Xu, Tomball, TX (US); Zhiyue Xu, Cypress, TX (US)

(72) Inventors: Zhihui Zhang, Katy, TX (US); YingQing Xu, Tomball, TX (US); Zhiyue Xu, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 129 days.

(21) Appl. No.: 16/680,789

(22) Filed: Nov. 12, 2019

(65) Prior Publication Data

US 2021/0140268 A1 May 13, 2021

(51) Int. Cl.
*E21B 33/134* (2006.01)
*E21B 33/129* (2006.01)

(52) U.S. Cl.
CPC ..... *E21B 33/134* (2013.01); *E21B 33/129* (2013.01)

(58) Field of Classification Search
CPC ..... E21B 33/0422; E21B 33/1265; E21B 33/129; E21B 33/134; E21B 19/10; E21B 23/01
See application file for complete search history.

(56) References Cited

U.S. PATENT DOCUMENTS

| | | | | |
|---|---|---|---|---|
| 4,356,034 | A * | 10/1982 | Badrak | B22F 3/1017 419/17 |
| 4,802,539 | A * | 2/1989 | Hall | E21B 10/20 175/371 |
| 8,528,633 | B2 | 9/2013 | Agrawal et al. | |
| 9,101,978 | B2 | 8/2015 | Xu et al. | |
| 9,970,249 | B2 | 5/2018 | Zhang et al. | |
| 10,016,810 | B2 | 7/2018 | Salinas et al. | |
| 10,221,637 | B2 | 3/2019 | Xu et al. | |
| 2012/0292053 | A1 | 11/2012 | Xu et al. | |
| 2013/0048305 | A1 | 2/2013 | Xu et al. | |
| 2016/0230498 | A1 | 8/2016 | Walton et al. | |

(Continued)

FOREIGN PATENT DOCUMENTS

CN 106437615 A 2/2017

OTHER PUBLICATIONS

International Search Report for International Application No. PCT/US2020/059825, International Filing Date Nov. 10, 2020, dated Feb. 24, 2021, 3 pages.

(Continued)

*Primary Examiner* — Kristyn A Hall
*Assistant Examiner* — Dany E Akakpo
(74) *Attorney, Agent, or Firm* — Cantor Colburn LLP

(57) ABSTRACT

An anchoring device comprises a degradable substrate; and a ceramic biting member secured to an outer surface of the degradable substrate and configured for engagement with another member, the ceramic biting member comprising a ceramic material which has a density of greater than about 90% of theoretical density and contains one or more of the following: $Al_2O_3$; MgO; CaO; $SiO_2$; $TiO_2$; $Y_2O_3$; $ZrO_2$; SiC; BN, or $Si_3N_4$.

20 Claims, 3 Drawing Sheets

(56) References Cited

U.S. PATENT DOCUMENTS

| | | | | |
|---|---|---|---|---|
| 2018/0135369 | A1 | 5/2018 | Parekh et al. | |
| 2019/0323628 | A1* | 10/2019 | Olander | B65H 79/00 |
| 2021/0054719 | A1* | 2/2021 | Nichols | E21B 34/12 |

OTHER PUBLICATIONS

Written Opinion for International Application No. PCT/US2020/059825, International Filing Date Nov. 10, 2020, dated Feb. 24, 2021, 6 pages.

* cited by examiner

DEGRADABLE ANCHORING DEVICE WITH GAVANIC CORROSION RESISTANT COMPONENT INTERFACE

BACKGROUND

Wellbores are drilled in subsurface formations for the production of oil and gas. As oil and gas are often trapped in various zones at different depths, in many operations, it is required to anchor devices such as bridge plugs in a downhole location to facilitate their production. When on longer needed, the anchoring devices must be removed before following operations can begin.

One way to remove the anchoring devices is to degrade the devices using wellbore fluids. However, with the increasing use of recycled fluids with high chloride content, current anchoring devices may disintegrate prematurely due to galvanic corrosion, particularly at the interface between different components. Therefore, the development of anchoring devices that are resistant to galvanic corrosion at the components interface yet at the same time can be readily removed are very desirable.

BRIEF DESCRIPTION

An anchoring device comprises a degradable substrate; and a ceramic biting member secured to an outer surface of the degradable substrate and configured for engagement with another member, the ceramic biting member comprising a ceramic material which has a density of greater than about 90% of theoretical density and contains one or more of the following: $Al_2O_3$; MgO; CaO; $SiO_2$; $TiO_2$; $Y_2O_3$; $ZrO_2$; SiC; BN, or $Si_3N_4$.

A downhole assembly comprising the above described anchoring device is also disclosed.

BRIEF DESCRIPTION OF THE DRAWINGS

The following descriptions should not be considered limiting in any way. With reference to the accompanying drawings, like elements are numbered alike.

DETAILED DESCRIPTION

The inventors hereof have developed anchoring devices having a substrate and a ceramic biting member secured to an outer surface of the substrate. The substrate is degradable in downhole fluids so that the anchoring devices can be readily removed when no longer needed, yet the interface between the substrate and the ceramic biting member is resistant to galvanic corrosion so that the anchoring devices can maintain their structural integrity during use even when exposed to corrosive fluids such as recycled fluids with high chloride contents.

Figure 1:
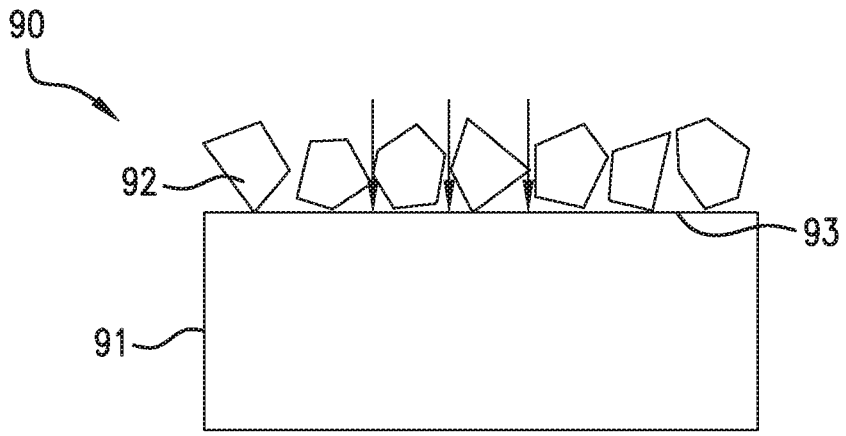
FIG. 1 (Prior Art)
FIG. 1 is a partial cross-sectional view of a comparative anchoring device having a granular gripping material disposed on a surface of a degradable substrate.

FIG. 1 illustrates a comparative anchoring device (90) having a granular gripping material (92) disposed on a surface (93) of a degradable substrate (91). In use, the granular gripping material can "bite" into a tubular wall such as a casing. However, electrochemical reactions can occur when downhole fluids pass through the granular gripping material and reach the degradable substrate. These electrochemical reactions can compromise the structural integrity of the anchoring device and cause the granular gripping material to separate from the substrate. The separation of the gripping material from the substrate can in turn cause the anchoring device to prematurely disengage from the tubular wall.

Figure 2:
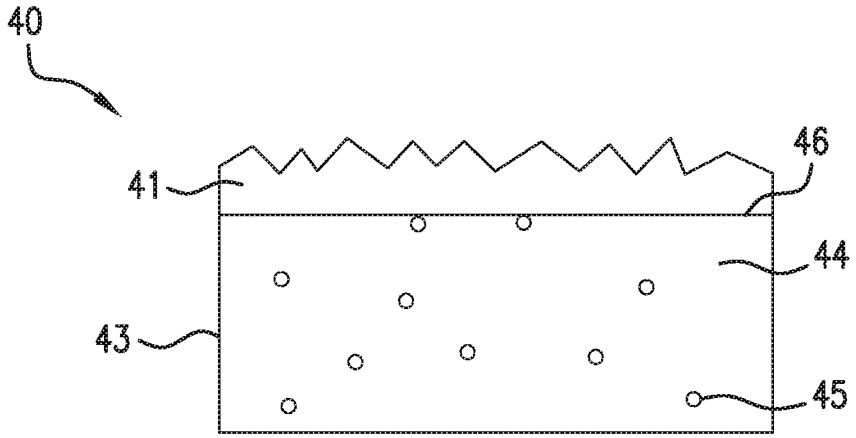
FIG. 2 is a partial cross-sectional view of an anchoring device according to an embodiment of the disclosure, the anchoring device having a pre-sintered one piece ceramic biting member secured to a surface of a degradable substrate.
Figure 3:
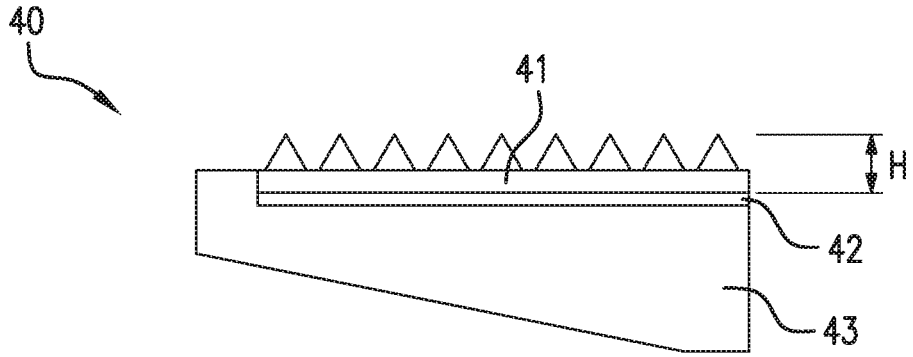
FIG. 3 is a partial cross-sectional view of an anchoring device according to another embodiment of the disclosure.
Figure 5:
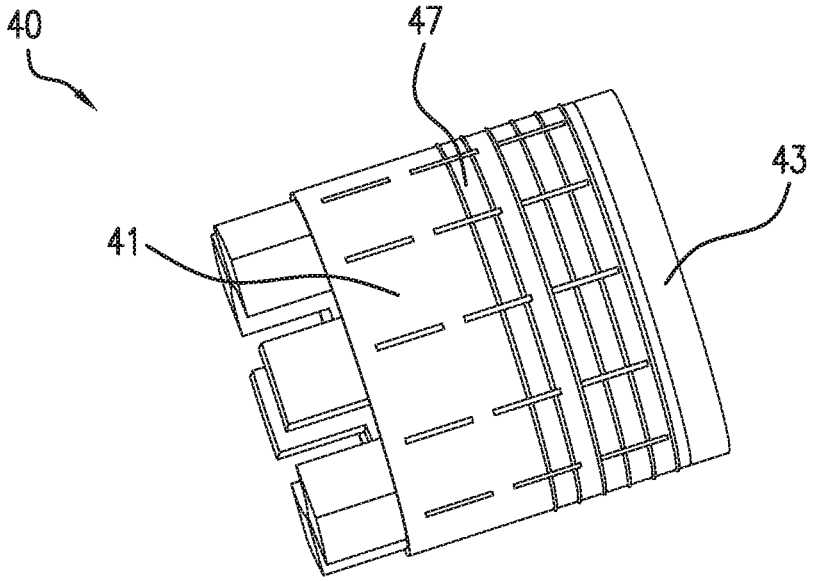
FIG. 5 illustrates the anchoring device made as illustrated in FIG. 4.

FIGS. 2, 3 and 5 illustrate an anchoring device (40) according to the disclosure. In the anchoring device (40), a ceramic biting member (41) is secured to an outer surface (46) of a degradable substrate (43) and configured for engagement with another member (not shown).

The ceramic biting member (41) is a one piece pre-sintered part, which is engineered through structural and material design to minimize the galvanic corrosion of the substrate surface that is in contact with the ceramic biting member. (also referred to as "interface") As used herein, "in contact with" includes both direct physical contact and indirect physical contact achieved by using an adhesive between the substrate and the ceramic biting member.

The ceramic biting member (41) comprises a ceramic material that includes $Al_2O_3$, MgO, CaO, $SiO_2$, $TiO_2$, $Y_2O_3$, $ZrO_2$, SiC, BN, $Si_3N_4$, or a combination comprising at least one of the foregoing. The combination can be a single compound (e.g. mullite $3Al_2O_3.2SiO_2$), or two or multiple phases in order to enhance the anchoring performance, to facilitate the sintering process, or both. Examples of the combination include aluminosilicates, zirconia toughened alumina, MgO stabilized zirconia, $Y_2O_3$ stabilized zirconia, and the like. Preferably the ceramic material includes $Al_2O_3$, SiC, $Zr_2O_3/Y_2O_3$, $Si_3N_4$, or a combination comprising at least one of the foregoing. The ceramic biting member can comprise about 90 wt % to about 100 wt %, about 95 wt % to about 99 wt %, or 100 wt % of the ceramic material based on the total weight of the ceramic biting member.

The ceramic material for the ceramic biting member is densified, and can have a density of greater than about 90% of theoretical density, specifically greater than about 95% of theoretical density, and more specifically greater than about 97% or greater than about 98% of theoretical density. The theoretical density of the ceramic material is the maximum density that can be achieved without any voids.

In general, porosity includes open and closed porosities. In closed porosity, the individual pores are isolated, while in open porosity, pores are connected with one another and to the external surface of an article, forming a network of pores. The ceramic biting member as disclosed herein has an open porosity of less than about 1%, specifically less than about 0.5%, more specifically less than about 0.1%. In an embodiment, the ceramic biting member is free of open pores.

Because the ceramic material has high density and low open porosity, downhole fluids cannot pass through the ceramic material to reach the surface (46) of the degradable substrate (43) that is covered by the ceramic biting member. Accordingly, the interface between the ceramic biting member (41) and the substrate (43), i.e., the surface (46) covered by the ceramic biting member, is resistant to galvanic corrosion. In an embodiment the outer surface (46) covered by the ceramic biting member has a corrosion rate of less than 0.01 $mg/cm^2$/hour or less than 0.001 $mg/cm^2$/hour using an aqueous 3 wt % KCl solution at 200° F.

The ceramic biting member can be very thin to facilitate the breaking of the biting member when it is no longer needed. In an embodiment, the biting member has a wall thickness ("H") of about 1/32 inch to about 1/16 inch. The surface of the biting member can be wedge-shaped with teeth or other protrusions for "biting" into a tubular wall, typically a casing, as load is applied to the anchoring device.

The ceramic biting member optionally has a plurality of openings (46), a plurality of grooves (47), or a combination thereof. When the anchoring device is engaged with another member such as a casing, the degradable substrate can expand under force. Without any openings and/or grooves, the expansion may cause the biting member to deform or even fracture at random locations, depending on the specific substrate material used. With the openings and/or grooves, the ceramic biting member can fracture along the openings/grooves, allowing the anchoring load to be evenly distributed on the ceramic biting member in a predefined manner. The presence of the openings/grooves, along with the thin wall feature of the ceramic biting member, also allows the ceramic biting member to be easily broken down into smaller pieces when it is no longer needed. The broken pieces of the ceramic biting member can be carried back to the surface by various wellbore fluids. Otherwise, large pieces of the biting member may be left in the wellbore. Moreover, the openings do not affect the structural integrity of the anchoring device. The downhole fluids can only reach the substrate in areas that are not covered by the ceramic biting member. The interface between the substrate and the biting member, i.e., the substrate surface area that is covered by the ceramic biting member excluding the openings, are not exposed to the wellbore fluids. Thus the bonding between the ceramic biting member and the substrate is not affected by the presence of the openings. In an embodiment, the ceramic biting member has a plurality of openings, each opening having an open area on an outer surface of the ceramic biting member, and the sum of the open area is about 5 to about 70%, about 10 to about 50%, about 10 to about 30%, or about 20 to about 30% based on a total area of the outer surface of the ceramic biting member. The openings can be evenly distributed along the axial direction of the ceramic biting member. But this is not required. The grooves, if present, can be distributed either evenly or within a portion of the ceramic biting member along the circumferential direction of the ceramic biting member. But this is not required.

The fabrication of the ceramic biting member includes forming a powder compact followed by sintering. The powder compact is be a loose powder body or a rigid green body (collectively "preform") that has enough strength to resist cracking during subsequent processing. The preform can be consolidated from dry powders, pastes or slurries via a shaping process including uniaxial die pressing, cold isostatic pressing, extrusion, slip casting, tape casting, and injection molding. Temporary additives such as binders, plasticizers, deflocculants or antifoaming agents can be added to the powders, pastes, or slurries to improve the forming and shaping process. To prevent flaws such as cracks, large voids or imperfections such as dimensional warping or distortion in the final sintered biting members, the preform can be thermally dried at a temperature lower than the sintering temperature to remove the liquids, binders, and additives added in the shape forming process. Prior to sintering, the preform has identifiable individual particles in point contact and a three-dimensional network of interconnected pores. The preform has a relative density of 50% to 65% of theoretical density.

Sintering as disclosed herein is a thermal diffusion process to fully densify the preform. As sintering starts, the particles become bonded together at their contact points, forming necks via mass transport (e.g. diffusion), and the strength of the biting members increases. Further sintering leads to an increase in the neck diameter, smoothing of the pore surface, densification of the part (or reduction in porosity) to an intermediate stage with the density increased from about 50-65% to about 90% of theoretical density. Mass transportation into the pores leads to further shrinkage and reduction of the porosity, and the continuous pore network eventually breaks up into individual isolated pores, as the density grows greater than about 95% of theoretical density. If desired, after the pores become isolated, reduction in porosity and shrinkage of pores can continue to a density around 99.8% of theoretical density.

Uniform packing of fine particles in the powder compact or green body is advantageous to produce high density sintered parts. The mean particle size of the ceramic particles used to make the biting member is less than about 25 microns, less than about 10 microns, or less than about 5 microns. Two groups of powders having different particle size ranges can be used together. For example, a fine micron-sized powder with a mean particle size of about 2 microns to about 5 microns can be used together with a submicron powder with a mean particle size of less than 1 micron.

Sintering methods include solid-state sintering, liquid-phase sintering, pressure sintering and field assisted sintering. In solid-state sintering, the preform is heated to a temperature that is about 0.5-0.9 Tm (Tm, the lowest melting point of the ceramic particles used to make the biting member) and held at that temperature for a period of from less than one hour to tens of hours. The smaller the particle size the lower the sintering temperature can be. A lower sintering temperature can be particularly beneficial to some materials, such as those with low evaporating pressure or decompose at higher temperatures. Nanopowders (particle size less <100 nm) can largely reduce the required sintering temperature to produce high density parts, for example, the sintering temperature can be reduced to lower than 0.5 Tm. In the solid state sintering process, silicon carbide (SiC) can be sintered at about 2000-2200° C. (SiC melting point>2700° C.), by adding $Al_2O_3$, $Y_2O_3$ and $SiO_2$ (total wt %<15%). Silicon carbide can also be sintered at lower temperature 1850-2000° C. with improved mechanical properties such as higher fracture toughness.

Liquid phase sintering (LPS) provides an alternative densification with fast sintering or lower sintering temperatures. In the LPS process, two or more solid powders such as $Al_2O_3$/SiC and $Y_2O_3/Al_2O_3/SiO_2$ with different melting points are mixed to form the powder compact or green body. Upon heating the mixed powder compact or green body, a liquid phase forms and co-exists with a solid phase. The liquid phase is about 1 to about 20 vol % based on the sum of the volume of the liquid phase and the solid phase. The liquid phase facilitates density increase by accommodating particle rearrangement and fast diffusion path.

During sintering, an external pressure can be applied to the powder compact or the shaped article to increase the densification rates or reduce the required the temperature to obtain a high density part compared to pressureless sintering.

The substrate of the biting member is degradable. The substrate, including the surfaces that not covered by the biting member, undergoes electrochemical reactions and degrades upon exposure to a fluid. The fluid may include any number of ionic fluids or highly polar fluids, such as those that contain various chlorides or bromides. Examples include fluids comprising potassium chloride (KCl), hydrochloric acid (HCl), calcium chloride ($CaCl_2$), calcium bromide ($CaBr_2$) or zinc bromide ($ZnBr_2$).

The degradable substrate has a corrosion rate of about 0.1 to about 450 mg/cm$^2$/hour, specifically about 1 to about 450 mg/cm$^2$/hour determined in aqueous 3 wt. % KCl solution at 200° F. (93° C.).

The degradable substrate comprises a matrix (44) of Zn, Mg, Al, Mn, an alloy thereof, or a combination comprising at least one of the foregoing. The degradable substrate can further comprise a disintegrating agent (45) including Ni, W, Mo, Cu, Fe, Cr, Co, an alloy thereof, or a combination comprising at least one of the foregoing dispersed in the matrix. The amount of the matrix is about 50 wt % to about 99.9 wt %, specifically about 70 wt % to about 99.9 wt %, more specifically about 85 wt % to about 99.9 wt % based on the total weight of the degradable substrate. The amount of the disintegrating agent is about 0.1 wt % to about 50 wt %, about 0.1 wt % to about 15 wt %, or about 0.1 wt % to about 15 wt %, each based on the total weight of the degradable substrate.

Optionally, the degradable substrate further comprises additional materials such as carbides, nitrides, oxides, precipitates, dispersoids, glasses, carbons, or the like in order to control the mechanical strength and density of the disintegrable article.

Methods of making the degradable substrate have been described, for example, in U.S. Pat. Nos. 8,528,633, 9,101,978, 10,221,637, and 10,016,810. The degradable substrate can have a cylindrical shape.

Figure 4:
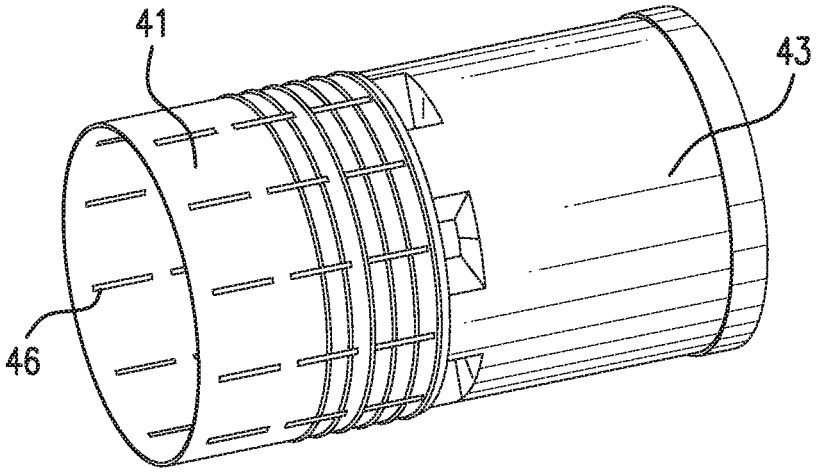
FIG. 4 illustrates a process of making an anchoring device.

The biting member (41) can be slid onto the degradable substrate (43) as illustrated in FIG. 4. In an embodiment, the degradable substrate is in direct physical contact with the ceramic biting member. There is no adhesive between the substrate and the ceramic biting member. Preferably, before the installation, the outer diameter (OD) of the degradable substrate is slightly larger than the inner diameter (ID) of the ceramic biting member to ensure that the biting member is tightly fitted onto the substrate such that fluids cannot get between the substrate and the ceramic biting member.

Alternatively, an adhesive is used to secure the ceramic biting member to a surface of the degradable substrate. Examples of the adhesives include acrylonitrile, cyanoacrylate, acrylic, epoxy, phenolic, polyester, silicone, or a combination comprising at least one of the foregoing. The adhesives can form a layer (42) having a thickness of about 1/1000 inch to about 4/1000 inch.

Figure 6:
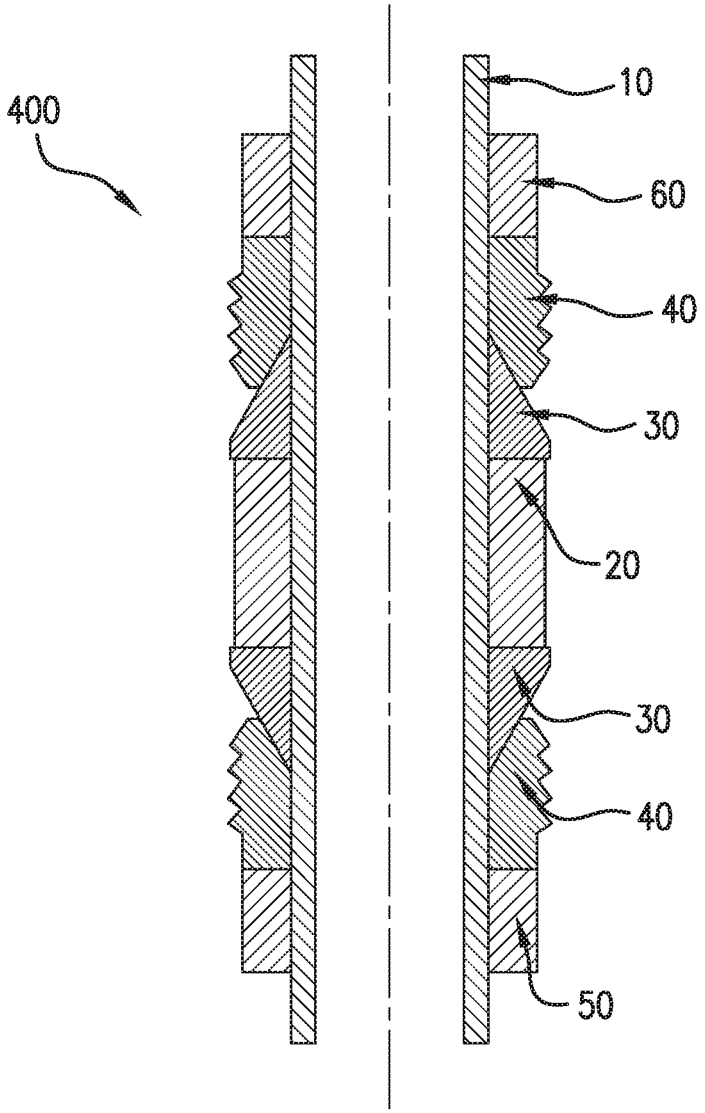
FIG. 6 illustrates a downhole assembly comprising the anchoring device of FIG. 2, 3, or 5.

The anchoring device disclosed herein can be used in various downhole tools to anchor the tools in place once set. For example, the anchoring device, through the member may be wedge-shaped for engaging with another member such as a tubular wall in response to a load applied to the anchor member. An exemplary downhole apparatus comprising the anchor member is shown in FIG. 6. Referring to FIG. 6, a downhole apparatus 400 includes a bottom sub 50 that is disposed at an end of the tool. A seal member 20 is radially expandable in response to being moved longitudinally against a frustoconical member 30. One way of moving the seal member 20 relative to the frustoconical member 30 is to compress longitudinally the apparatus with a setting tool (not shown) via abutment member 60. The apparatus also includes an anchoring device 40, such as the one illustrated in FIGS. 2, 3, and 5. The frustoconical member 30, the seal member 20, the anchor member 40, the abutment member 60, and the bottom sub 50 can all be disposed about an annular body 10, which is a tubing, mandrel, or the like. In specific embodiments, the downhole apparatus is a frac plug, a bridge plug, or a packer.

Set forth below are various embodiments of the disclosure.

Embodiment 1. An anchoring device, comprising: a degradable substrate; and a ceramic biting member secured to an outer surface of the degradable substrate and configured for engagement with another member, the ceramic biting member comprising a ceramic material which has a density of greater than about 90% of theoretical density and contains one or more of the following: $Al_2O_3$; MgO; CaO; $SiO_2$; $TiO_2$; $Y_2O_3$; $ZrO_2$; SiC; BN, or $Si_3N_4$.

Embodiment 2. The anchoring device as in any prior embodiment, wherein the degradable substrate has a corrosion rate of about 0.1 to about 450 mg/cm$^2$/hour using an aqueous 3 wt % KCl solution at 200° F.

Embodiment 3. The anchoring device as in any prior embodiment, wherein the ceramic biting member at least partially covers the outer surface of the degradable substrate, and the outer surface of the degradable substrate that is covered by the ceramic biting member is resistant to galvanic corrosion.

Embodiment 4. The anchoring device as in any prior embodiment, wherein the outer surface of the degradable substrate that is covered by the ceramic biting member has a corrosion rate of less than 0.01 mg/cm$^2$/hour using an aqueous 3 wt % KCl solution at 200° F.

Embodiment 5. The anchoring device as in any prior embodiment, wherein the ceramic material has a density of greater than about 95% of theoretical density.

Embodiment 6. The anchoring device as in any prior embodiment, wherein the ceramic material has an open porosity of less than about 1%.

Embodiment 7. The anchoring device as in any prior embodiment, wherein the ceramic material is free of open pores.

Embodiment 8. The anchoring device as in any prior embodiment, wherein the ceramic biting member is a sintered one piece component.

Embodiment 9. The anchoring device as in any prior embodiment, wherein the ceramic biting member has a wall thickness of about 1/32 inch to about 1/16 inch.

Embodiment 10. The anchoring device as in any prior embodiment, wherein the ceramic biting member has a plurality of openings, a plurality of grooves, or a combination thereof.

Embodiment 11. The anchoring device as in any prior embodiment, wherein the ceramic biting member has a plurality of openings, each opening having an open area on an outer surface of the ceramic biting member, and the sum of the open area is about 5 to about 70% based on a total area of the outer surface of the ceramic biting member.

Embodiment 12. The anchoring device as in any prior embodiment, wherein the degradable substrate comprises greater than about 50 wt % of one or more of the following: Zn; Mg; Al; or Mn based on the total weight of the degradable substrate.

Embodiment 13. The anchoring device as in any prior embodiment, wherein the degradable substrate further comprises greater than about 0.05 wt % to less than about 50 wt % of one or more of the following: Ni; W; Mo; Cu; Fe; Cr; or Co based on the total weight of the degradable substrate.

Embodiment 14. The anchoring device as in any prior embodiment, further comprising an adhesive layer disposed between the degradable substrate and the ceramic biting member.

Embodiment 15. The anchoring device as in any prior embodiment, wherein the adhesive layer comprises one or more of the following: an acrylonitrile; a cyanoacrylate; an acrylic; an epoxy; a phenolic; a polyester; or a silicone.

Embodiment 16. The anchoring device as in any prior embodiment, wherein the degradable substrate is in direct physical contact with the ceramic biting member.

Embodiment 17. The anchoring device as in any prior embodiment, wherein there is no adhesive between the substrate and the ceramic biting member.

Embodiment 18. A downhole assembly comprising the anchoring device as in any prior embodiment.

Embodiment 19. The downhole assembly as in any prior embodiment, wherein the downhole assembly is a frac plug or a bridge plug.

Embodiment 20. The downhole assembly as in any prior embodiment, wherein the degradable substrate has a corrosion rate of about 0.1 to about 450 mg/cm$^2$/hour using an aqueous 3 wt % KCl solution at 200° F., and the outer surface of the degradable substrate that is covered by the ceramic biting member has a corrosion rate of less than 0.01 mg/cm$^2$/hour using an aqueous 3 wt % KCl solution at 200° F.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. An anchoring device, comprising:

a degradable substrate; and a ceramic biting member secured to an outer surface of the degradable substrate and configured for engagement with another member, the ceramic biting member comprising a ceramic material which has a density of greater than about 90% of theoretical density and contains one or more of the following: $Al_2O_3$; MgO; CaO; $SiO_2$; $TiO_2$; $Y_2O_3$; $ZrO_2$; SiC; BN, or $Si_3N_4$, wherein the ceramic biting member has a plurality of openings, a plurality of grooves, or a combination thereof.

2. The anchoring device of claim 1, wherein the degradable substrate has a corrosion rate of about 0.1 to about 450 mg/cm$^2$/hour using an aqueous 3 wt % KCl solution at 200° F.

3. The anchoring device of claim 1, wherein the ceramic biting member at least partially covers the outer surface of the degradable substrate, and the outer surface of the degradable substrate that is covered by the ceramic biting member is resistant to galvanic corrosion.

4. The anchoring device of claim 3, wherein the outer surface of the degradable substrate that is covered by the ceramic biting member has a corrosion rate of less than 0.01 mg/cm$^2$/hour using an aqueous 3 wt % KCl solution at 200° F.

5. The anchoring device of claim 1, wherein the ceramic material has a density of greater than about 95% of theoretical density.

6. The anchoring device of claim 1, wherein the ceramic material has an open porosity of less than about 1%.

7. The anchoring device of claim 1, wherein the ceramic material is free of open pores.

8. The anchoring device of claim 1, wherein the ceramic biting member is a sintered one piece component.

9. The anchoring device of claim 1, wherein the ceramic biting member has a wall thickness of about 1/32 inch to about 1/16 inch.

10. The anchoring device of claim 1, wherein the ceramic biting member has the plurality of openings, each opening having an open area on an outer surface of the ceramic biting member, and the sum of the open area is about 5 to about 70% based on a total area of the outer surface of the ceramic biting member.

11. The anchoring device of claim 1, wherein the degradable substrate comprises greater than about 50 wt % of one or more of the following: Zn; Mg; Al; or Mn based on the total weight of the degradable substrate.

12. The anchoring device of claim 11, wherein the degradable substrate further comprises greater than about 0.05 wt % to less than about 50 wt % of one or more of the following: Ni; W; Mo; Cu; Fe; Cr; or Co based on the total weight of the degradable substrate.

13. The anchoring device of claim 1, further comprising an adhesive layer disposed between the degradable substrate and the ceramic biting member.

14. The anchoring device of claim 13, wherein the adhesive layer comprises one or more of the following: an acrylonitrile; a cyanoacrylate; an acrylic; an epoxy; a phenolic; a polyester; or a silicone.

15. The anchoring device of claim 1, wherein the degradable substrate is in direct physical contact with the ceramic biting member.

16. The anchoring device of claim 15, wherein there is no adhesive between the substrate and the ceramic biting member.

17. The anchoring device of claim 1, wherein the degradable substrate has a corrosion rate of about 0.1 to about 450 mg/cm$^2$/hour using an aqueous 3 wt % KCl solution at 200° F., and the outer surface of the degradable substrate that is covered by the ceramic biting member has a corrosion rate of less than 0.01 mg/cm$^2$/hour using an aqueous 3 wt % KCl solution at 200° F.

18. A downhole assembly comprising the anchoring device of claim 1.

19. The downhole assembly of claim 18, wherein the downhole assembly is a frac plug or a bridge plug.

20. The downhole assembly of claim 18, wherein the degradable substrate has a corrosion rate of about 0.1 to about 450 mg/cm$^2$/hour using an aqueous 3 wt % KCl solution at 200° F., and the outer surface of the degradable substrate that is covered by the ceramic biting member has a corrosion rate of less than 0.01 mg/cm$^2$/hour using an aqueous 3 wt % KCl solution at 200° F.

* * * * *